US007050014B1

(12) United States Patent
Chen et al.

(10) Patent No.: US 7,050,014 B1
(45) Date of Patent: May 23, 2006

(54) LOW PROFILE HORIZONTALLY POLARIZED SECTOR DIPOLE ANTENNA

(75) Inventors: Xi Fan Chen, Waterloo (CA); Guozhong Jiang, Kitchener (CA)

(73) Assignee: SuperPass Company Inc., Waterloo (CA)

( * ) Notice: Subject to any disclaimer, the term of this patent is extended or adjusted under 35 U.S.C. 154(b) by 0 days.

(21) Appl. No.: 11/013,345

(22) Filed: Dec. 17, 2004

(51) Int. Cl.
*H01Q 9/28* (2006.01)

(52) U.S. Cl. ..... 343/795

(58) Field of Classification Search ..... 343/795, 343/793, 819, 700 MS, 815, 817, 818
See application file for complete search history.

(56) References Cited

U.S. PATENT DOCUMENTS

| | | | | |
|---|---|---|---|---|
| 5,021,799 | A * | 6/1991 | Kobus et al. | 343/795 |
| 5,986,609 | A * | 11/1999 | Spall | 343/702 |
| 6,025,811 | A * | 2/2000 | Canora et al. | 343/793 |
| 2002/0084943 | A1* | 7/2002 | Tsai et al. | 343/795 |
| 2003/0034917 | A1* | 2/2003 | Nishizawa et al. | 343/700 MS |
| 2005/0110698 | A1* | 5/2005 | Surducan et al. | 343/795 |

* cited by examiner

*Primary Examiner*—Tan Ho
*Assistant Examiner*—Angela M Lie
(74) *Attorney, Agent, or Firm*—Fasken Martineau DuMoulin LLP

(57) ABSTRACT

The present invention relates generally to the field on antennas and more specifically, to a low profile horizontally polarized sector antenna. The antenna includes a printed circuit board that has a dielectric substrate provided with a pair of first and second opposed faces and at least one dipole element formed on the dielectric substrate. The at least one dipole element has a pair of first and second, oppositely extending, dipole arms. The first dipole arm is formed on the first face of the dielectric substrate and the second dipole arm is formed on the second face thereof. The at least one dipole element has a width W corresponding to the span between the first and second dipole arms. The printed circuit board is also provided with a feed network that is operatively connected to the at least one dipole element. The antenna further includes a pair of conductive boards mounted to the dielectric substrate to stand proud of the second face thereof. The conductive boards are spaced from each other a distance D. The distance D is greater than the width W. The distance D is selected to obtain an E-Plane beamwidth for the antenna ranging from about 90 degrees to about 240 degrees. The antenna also has a ground plane that is operatively connected to the pair of conductive boards.

16 Claims, 9 Drawing Sheets

LOW PROFILE HORIZONTALLY POLARIZED SECTOR DIPOLE ANTENNA

FIELD OF INVENTION

The present invention relates generally to the field on antennas and more specifically, to a low profile horizontally polarized sector antennas.

BACKGROUND OF THE INVENTION

In the area of wireless communication systems, the need to increase capacity while minimizing possible interference with existing vertically polarized systems, has created a strong demand for horizontally polarized ("H-POL") antennas.

Directional H-POL antennas tend to be relatively easy to design and may be manufactured cost effectively. However, at present, the design and manufacture of sector H-POL antennas still tends to pose certain challenges. More specifically, conventional sector H-POL antennas are usually configured as waveguide slot antennas. Manufacturing of these antennas tends to be an involved process entailing, among other things, the formation of a waveguide and the cutting of a slot into the waveguide. The manufacturing tolerances for such antennas tend to be quite small. Another known H-POL sector antenna is constructed using wheel dipole technology whereby the antenna is formed by stacking several dipole elements. Assembly of this antenna tends to be complicated.

While certain sector H-POL antennas are available on the market, they tend to be bulky and/or expensive. These drawbacks have tended to discourage use of sector H-POL antennas in establishing base stations for systems including mobile communication, wireless Local Area Network (LAN), Unlicensed National Information Infrastructure ("UNII"), Multi-channel Multi-point Distribution Service ("MMDS"), and Wireless Local Loop ("WLL") Systems.

One common type of antenna is the dipole antenna which has a quarter wavelength dipole radiator coupled with a balanced transmission line and balun to drive a signal source or a receiver. A conventional dipole antenna has an omni-directional H-Plane radiation pattern and typically, an E-Plane beamwidth of about 80 degrees. This beamwith may be reduced with a reflector. However, it has been found that use of a reflector tends not to significantly affect the E-Plane beamwidth. While adjusting the H-Plane radiation pattern of such dipole antennas is generally known, there currently does not appear to be an effective way to broaden the E-Plane beamwidth of such dipole antennas.

Accordingly, it would be very desirable to have a dipole antenna of relatively simple design, which could be manufactured cost effectively and whose E-Plane beamwidth could be expanded to have a broad range. Such a dipole antenna could be adapted to suit a variety of applications thereby making it very versatile.

SUMMARY OF THE INVENTION

According to a broad aspect of the present invention, there is provided a horizontally polarized sector dipole antenna. The antenna includes a printed circuit board that has a dielectric substrate provided with a pair of first and second opposed faces and at least one dipole element formed on the dielectric substrate. The at least one dipole element has a pair of first and second, oppositely extending, dipole arms. The first dipole arm is formed on the first face of the dielectric substrate and the second dipole arm is formed on the second face thereof. The at least one dipole element has a width W corresponding to the span between the first and second dipole arms. The printed circuit board is also provided with a feed network that is operatively connected to the at least one dipole element. The antenna further includes a pair of conductive boards mounted to the dielectric substrate to stand proud of the second face thereof. The conductive boards are spaced from each other a distance D. The distance D is greater than the width W. The distance D is selected to obtain an E-Plane beamwidth for the antenna ranging from about 90 degrees to about 240 degrees. The antenna also has a ground plane that is operatively connected to the pair of conductive boards.

In an additional feature of the invention, the E-Plane beamwidth is inversely proportional to the distance D.

In a yet another feature, the antenna has a single dipole element, and the dipole arms of the single dipole element are generally straight. Additionally, the E-Plane beamwidth of the antenna lies between about 120 degrees and about 240 degrees. In still a further feature, the width W is 48 mm and the distance D lies between about 70 mm and about 60 mm.

In an additional feature, the antenna includes four dipole elements formed on the dielectric substrate. Each dipole element has a pair of first and second, oppositely extending, dipole arms. The first dipole arm is formed on the first face of the dielectric substrate and the second dipole arm is formed on the second face thereof. Each dipole element has a width W corresponding to the span between the first and second dipole arms. The E-Plane beamwidth of the antenna ranges from about 90 degrees to about 180 degrees. In a further feature, the dipole arms of each dipole element are generally straight. Additionally, the E-Plane beamwidth of the antenna lies between about 90 degrees and about 120 degrees. In yet another feature, the dipole arms of each dipole element are generally T-shaped and the E-Plane beamwidth of the antenna lies between about 120 degrees and about 180 degrees.

BRIEF DESCRIPTION OF THE DRAWINGS

The embodiments of the present invention shall be more clearly understood with reference to the following detailed description of the embodiments of the invention taken in conjunction with the accompanying drawings, in which.

DETAILED DESCRIPTION OF EMBODIMENTS OF THE INVENTION

Figure 1:
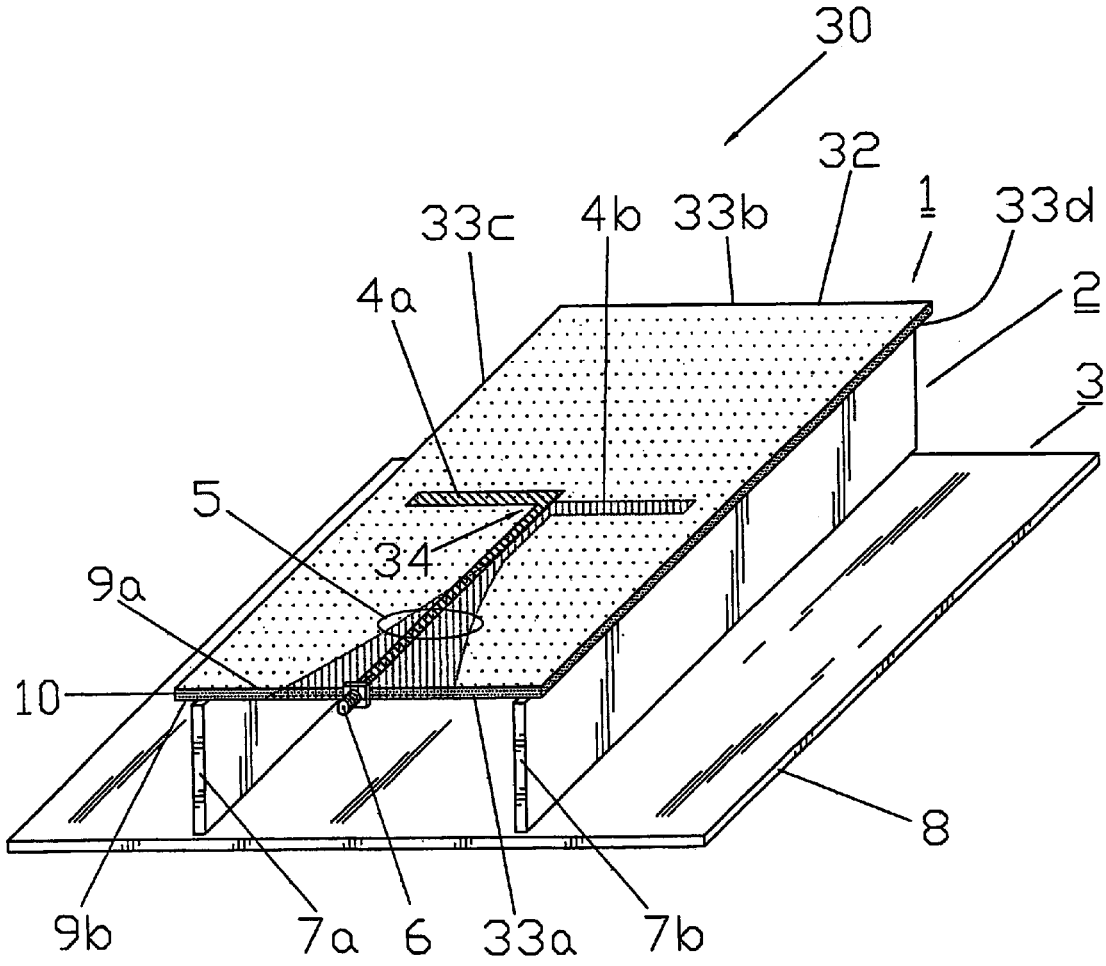
FIG. 1 is a perspective view of a single element HSD antenna, according to an embodiment of the invention.

The description which follows, and the embodiments described therein are provided by way of illustration of an example, or examples of particular embodiments of principles and aspects of the present invention. These examples are provided for the purposes of explanation and not of limitation of those principles of the invention. In the description that follows, like parts are marked throughout the specification and the drawings with the same respective reference numerals.

Figure 2A:
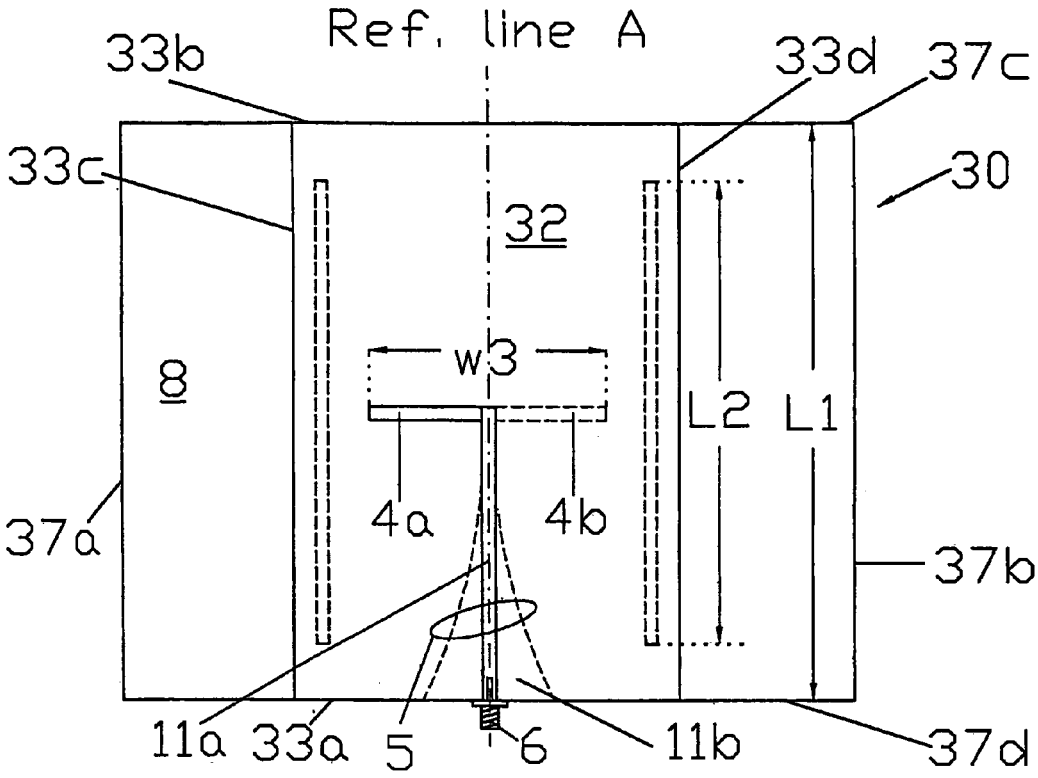
FIG. 2*a* is a top plan view of the HSD antenna shown in FIG. 1.
Figure 2B:
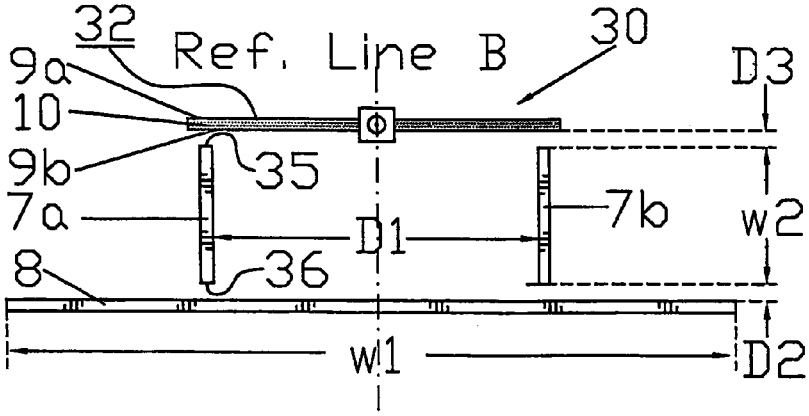
FIG. 2*b* is an exploded, end elevation view of the HSD antenna shown in FIG. 1.

Referring to FIGS. 1, 2*a* and 2*b*, there is a shown a single element H-POL sector dipole ("HSD") antenna designated generally with reference numeral 30. The HSD antenna 30 is horizontally polarized, and may be used to provide a relatively broad, E-Plane beamwidth, as will be described in greater detail below. As shown in FIG. 2*a*, the HSD antenna 30 is a generally symmetrical structure having three main assemblies—more specifically, first, second and third assemblies 1, 2 and 3, respectively. The first and second assemblies 1 and 2 are carried on the third assembly 3.

The first assembly 1 has a printed circuit board (PCB) 32 that includes a generally planar, dielectric substrate 10, a dipole 34 and a matching feed network 5. The dielectric substrate 10 is generally rectangular and has a pair of short sides 33*a* and 33*b* and a pair of long sides 33*c* and 33*d*. The dielectric substrate 10 also has a pair of opposed faces 9*a* and 9*b* upon which are adhered relatively, thin copper sheets. Preferably, the dielectric substrate 10 is fabricated from low-loss, RF-35 laminate.

The dipole 34 is centrally disposed on the dielectric substrate 10 and extends longitudinally from short side 33*a* substantially midway on the dielectric substrate 10. The dipole 34 is provided with a pair of generally straight, radiating arms 4*a* and 4*b* that may be formed on the respective faces 9*a* and 9*b* of the PCB 32 by etching or milling. As shown, in FIG. 2*a*, the radiating arm 4*a* formed on face 9*a* extends towards long side 33*c* of the dielectric substrate 10 while the radiating arm 4*b* formed on face 9*b* extends towards long side 33*d*. The dipole 34 has a width W3 corresponding to the span of radiating arms 9*a* and 9*b* measured end-to-end. In this embodiment, W3 measures 48 mm.

The feed network 5 includes first and second parts 11*a* and 11*b*. In this embodiment, the first part 11*a* is relatively narrower than the second part 11*b*. The feed network 5 serves to operatively connect the dipole 34 to a connector 6 mounted to the short side 33*a* of dielectric substrate 10. More specifically, the feed network 5 permits radio frequency ("RF") signals to be transmitted from the connector 6 to the pair of radiating arms 4*a* and 4*b*. In this embodiment, the connector 6 is a 50 Ohm connector and has an inner conductor, an outer conductor and an insulator. The inner conductor is connected to the first, relatively narrower, part 11*a* of the feed network 5, while the outer conductor is connected to the second, relatively wider, part 11*b*. The feed network 5 also functions as a wide band balun such that there is little common current flow in the outer conductor or shield of the connector 6.

The second assembly 2 has a pair of spaced apart, elongate, conductive boards 7*a* and 7*b*. As shown in FIGS. 2*a* and 2*b*, each conductive board 7*a*, 7*b* has a first longitudinal edge 35 for connecting to the first assembly 1 and a second opposed longitudinal edge 36 for connecting to the third assembly 3. More specifically, the conductive boards 7*a* and 7*b* are attached to face 9*b* of PCB 32 along their respective first longitudinal edges 35. Thus attached, the conductive boards 7*a* and 7*b* are disposed to stand proud of face 9*b*. Mounted to the respective, second longitudinal edges 36 of the conductive boards 7*a* and 7*b*, is the third assembly 3. Each conductive board 7*a*, 7*b* has a length L2 and a width W2. In this embodiment, the length L2 measures 82 mm while the width W2 measures 24 mm. The conductive boards 7*a* and 7*b* are spaced apart from each other a distance D1 (shown on FIGS. 2*b*). As will be explained in greater detail below, the provision of conductive boards 7*a* and 7*b* and the relative spacing (distance D1) from each other, may be used to shape the E-Plane radiation pattern of the HSD antenna 30.

The third assembly 3 includes a conductive ground plane 8 that is generally rectangular and has a pair of short sides 37*a* and 37*b* and a pair of long sides 37*c* and 37*d*. The conductive boards 7*a* and 7*b* are centrally disposed on the ground plane 8 and extend generally parallel to the short sides 37*a* and 37*b* thereof. The ground plane 8 has a width W1 and a length L1 (as shown in FIGS. 2*a* and 2*b*). In this embodiment, the length L1 measures 81 mm and the width W1 is 112 mm.

Regarding assembly of the PCB 32, the conductive boards 7*a* and 7*b* and the ground plane 8, it has been observed that the HSD antenna 30 tends to perform relatively well even where there exists some discrepancies in assembly. This is explained in greater detail with specific reference to FIG. 2*b* and parameters D2 and D3 identified thereon. The distance D3 represents the gap between the face 9*b* of dielectric layer 10 and the respective longitudinal edges 35 of the conductive boards 7*a* and 7*b*, whereas the distance D2 represents the gap between the respective longitudinal edges 36 of the conductive boards 7*a* and 7*b* and the upper face of the ground plane 8. It has been observed that even when the distances D2 and D3 measure up to 3 mm, the performance of the HSD antenna 30 has tended not to significantly deteriorate. It will thus be appreciated that the HSD antenna can be assembled within relatively broad manufacturing tolerances. This is advantageous because it tends to keep manufacturing costs low, thereby making the use of these antennas more affordable.

Figure 3:
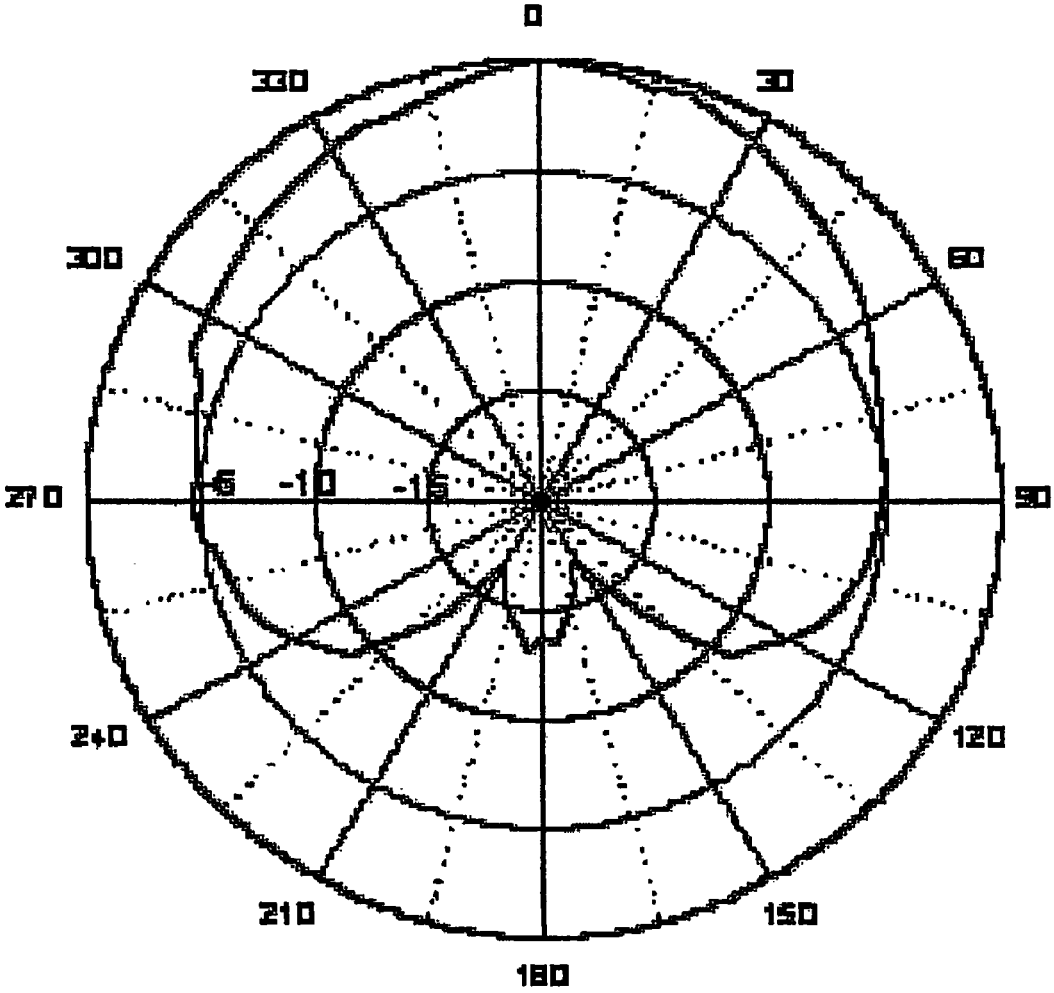
FIG. 3 is a diagram showing a plot in polar coordinates of the E-Plane radiation pattern of the HSD antenna of FIG. 1, where the HSD antenna has an E-Plane beamwidth of 120 degrees.

In this embodiment, the operating frequency of the HSD antenna 30 ranges from about 2.400 GHZ to about 2.483 GHZ and the distance D1 measures 70 mm. The spacing the conductive boards 7*a* and 7*b* in this manner enables the HSD antenna 30 to achieve an E-Plane beamwidth of about 120 degrees. The E-Plane radiation pattern for this HSD antenna is shown in FIG. 3. It will be appreciated that a horizontally polarized omni-directional radiation pattern may be achieved by combining three such HSD antennas together.

Figure 4:
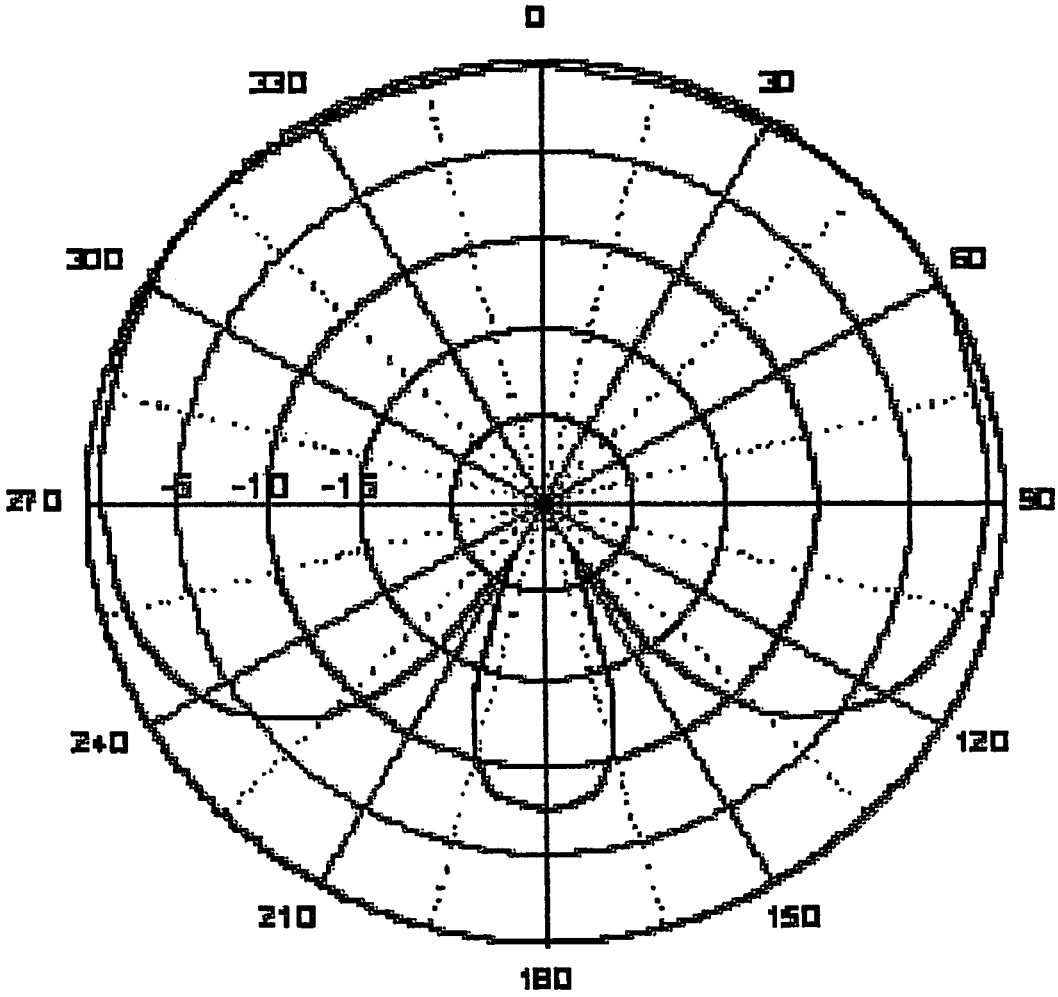
FIG. 4 is a diagram showing a plot in polar coordinates of the E-Plane radiation pattern of the HSD antenna of FIG. 1, where the HSD antenna has an E-Plane beamwidth of 240 degrees.

It has been found that the E-Plane beamwidth of the HSD antenna 30 may be controlled by varying the spacing (distance D1) between the conductive boards 7*a* and 7*b*. It has further been observed that the change in distance D1 tends to have a minimal effect on the return loss; the latter tending to remain substantially the same. Similarly, the radiation pattern of the HSD antenna 30 tends to be undistorted. For instance, by reducing distance D1 to 60 mm, an E-plane beamwidth of about 240 degrees may be obtained. The E-Plane radiation pattern of this HSD antenna is shown in FIG. 4. Accordingly, it has been found that the E-Plane beamwidth tends to be inversely proportional to the distance D1 such that, generally speaking, the smaller the distance D1, the broader the E-Plane beamwidth of the HSD antenna 30. It should, however, be appreciated that the above relationship is subject to the constraint that the distance D1 should be greater than the width W3 to prevent distortion of the E-Plane radiation pattern.

The chart below lists certain key technical specifications of the HSD antenna 30 using different distance D1 values.

| Distance D1 | E-Plane Beamwidth | Gain | F/B | Cross-Polarization |
|---|---|---|---|---|
| 70 mm | 120 Degrees | 5 dB | −13.5 dB | −20 dB (min) |
| 60 mm | 240 Degrees | 3 dB | −7.8 dB | −20 dB (min) |

In the foregoing examples, it has been shown that HSD antenna structure may be adapted to provide a relatively, broad E-Plane beamwidth ranging from about 120 degrees to about 240 degrees. The E-Plane beamwidth may be controlled by adjusting the spacing between the conductive boards 7*a* and 7*b*. It should however be further appreciated that with proper adjustment the HSD antenna described above, could also be used to obtain a relatively narrower, E-Plane beamwidth of about 90 degrees or greater, if desired.

Advantageously, employing the principles of the present invention, a broad range of E-Plane beamwidths can be achieved with an antenna structure that is not substantially bigger than a conventional directional dipole antenna provided with a reflector. As a result, the HSD antenna 30 tends not to be bulky and benefits from a relatively low profile.

Figure 5A:
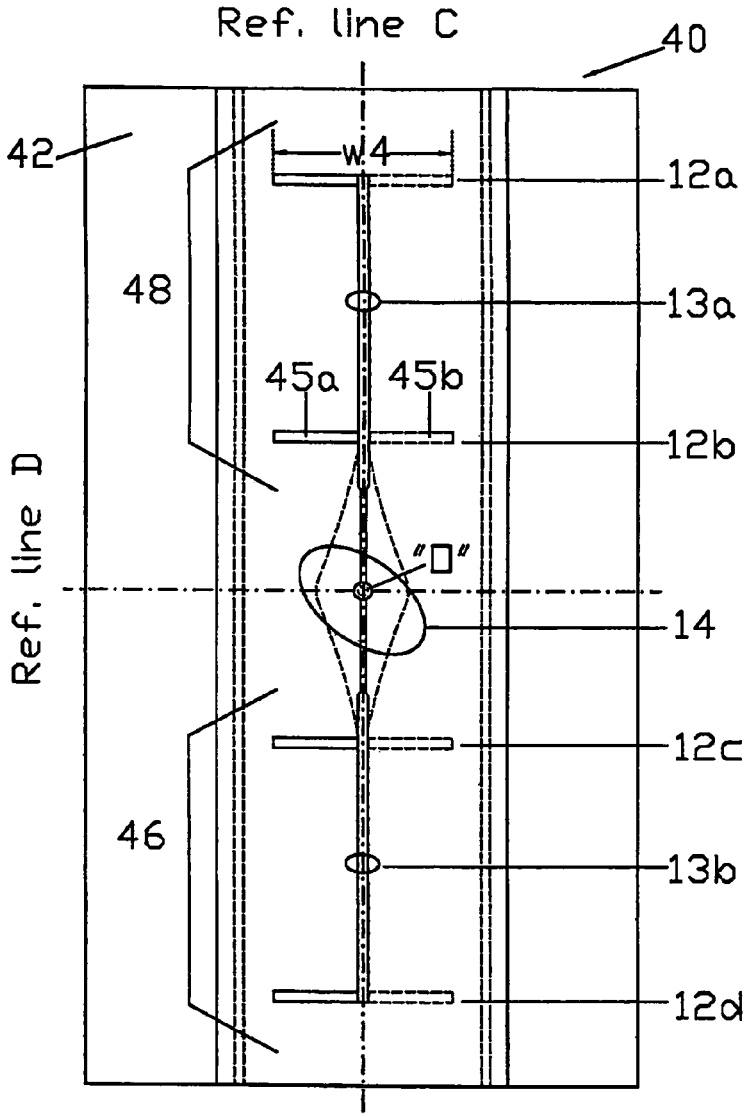
FIG. 5*a* is a top plan view of an HSD antenna having multiple dipole elements, according to an alternative embodiment of the invention.
Figure 5B:
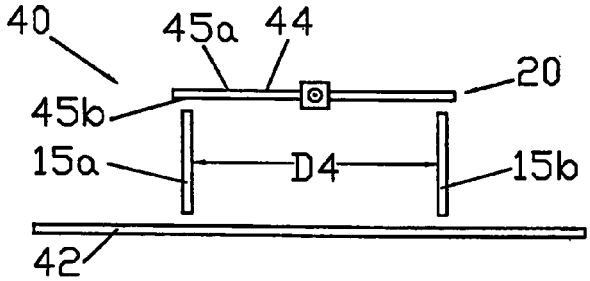
FIG. 5*b* is an exploded, end elevation view of the HSD antenna shown in FIG. 5*a;*

While in the foregoing embodiment of FIGS. 1, 2*a* and 2*b*, the HSD antenna 30 uses a single dipole element, it will be appreciated that in alternative embodiments, an HSD antenna may be provided with multiple dipole elements. Referring to FIGS. 5*a* and 5*b*, there is shown an alternative HSD antenna generally designated with reference numeral 40, having four dipole elements 12*a*, 12*b*, 12*c* and 12*d*. HSD antenna 40 is generally similar to HSD antenna 30 in that it has a PCB 20, a pair of conductive boards 15*a* and 15*b* and a ground plane 42. The PCB 20, the conductive boards 15*a* and 15*b*, and the ground plane 42 are assembled in much the same manner as their counterpart components 32, 7*a* and 7*b*, and 8 in HSD antenna 30. The HSD antenna 40 is generally symmetrical about reference line D. The point at which reference line C intersects reference line D defines the driving point "O" of the HSD antenna 40.

PCB 20 is generally similar to PCB 32 in that it has a generally planar, dielectric substrate 44 not unlike dielectric substrate 10. The dielectric substrate 44 also has a pair of opposed faces 45*a* and 45*b* upon which are adhered relatively, thin copper sheets. However, in place of a single dipole element 34, the PCB 20 has four dipole elements 12*a* and 12*b* (grouped in a first dipole pair 46) and 12*c* and 12*d* (grouped in a second dipole pair 48). Each dipole element 12*a*, 12*b*, 12*c*, 12*d* has a pair of radiating arms 46*a* and 46*b*, similar to radiating arms 4*a* and 4*b*, that are formed on the respective faces 45*a* and 45*b* of the PCB 20. In addition, each dipole element 12*a*, 12*b*, 12*c*, 12*d* has a width W4 corresponding to the span of radiating arms 46*a* and 46*b* measured end-to-end. In this embodiment, the width W4 measures 48 mm.

The dipole elements 12*a* and 12*b* are connected in series by the transmission line 13*a*, while the dipole elements 12*c* and 12*d* are connected in series by the transmission line 13*b*. The dipole elements of the first and second dipole pairs 46 and 48 are connected to the driving point "O" via the feed network 14.

Figure 6:
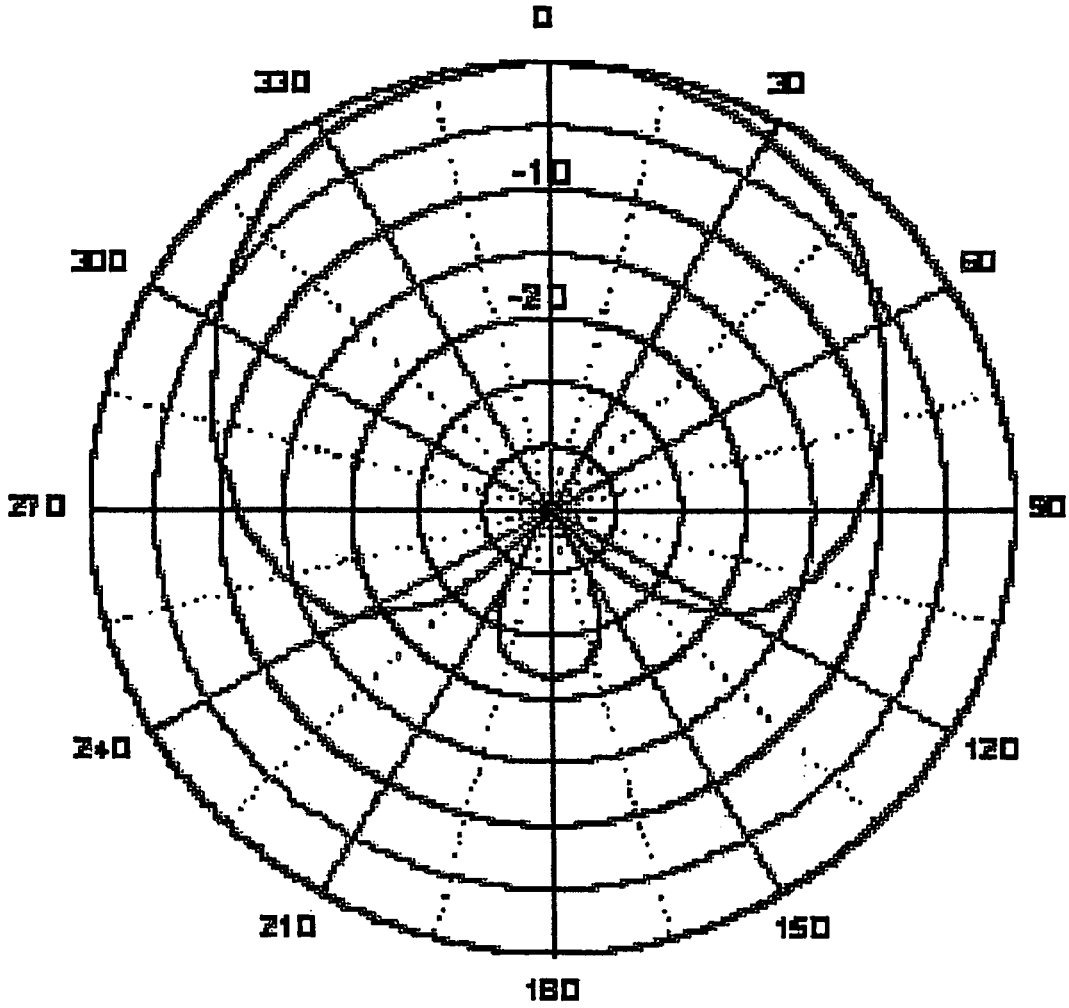
FIG. 6 is a diagram showing a plot in polar coordinates of the E-Plane radiation pattern of the HSD antenna of FIG. 5*a*, where the HSD antenna has an E-Plane beamwidth of 90 degrees.

The conductive boards 15*a* and 15*b* are spaced apart from each other a distance D4 (shown on FIG. 5*b*). In like fashion to HSD antenna 30, the E-Plane beamwidth of the HSD antenna 40 may be adjusted by varying the distance D4 between two conductive boards 15*a* and 15*b*. For instance, by setting the distance D4 at 70 mm, the HSD antenna 40 can achieve an E-Plane beamwidth of about 90 degrees. The E-Plane radiation pattern for this HSD antenna is shown in FIG. 6. It will be appreciated that a horizontally polarized omni-directional radiation pattern may be achieved by combining four such HSD antennas together.

Figure 7:
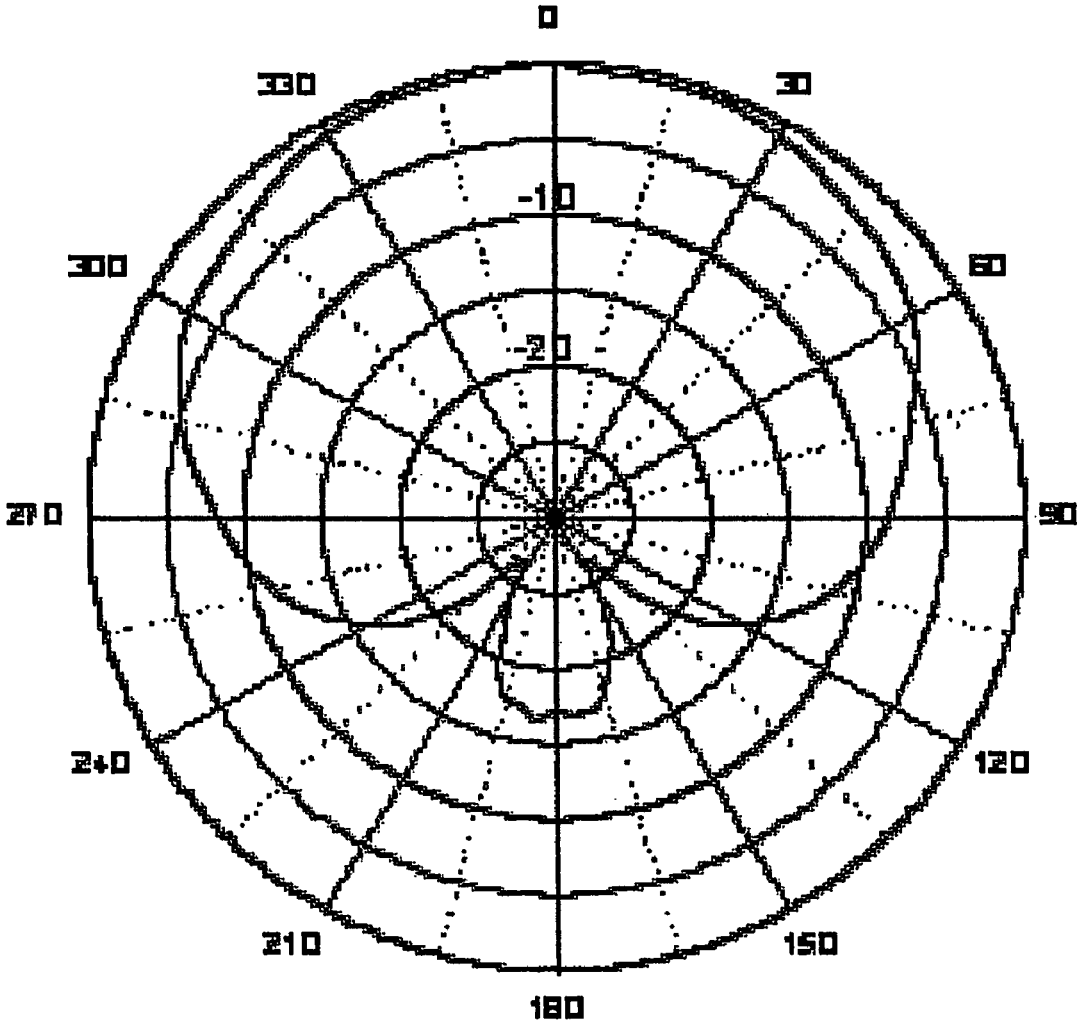
FIG. 7 is a diagram showing a plot in polar coordinates of the E-Plane radiation pattern of the HSD antenna of FIG. 5*a*, where the HSD antenna has an E-Plane beamwidth of 120 degrees.

If the distance D4 is reduced to 56 mm, an E-Plane beamwidth of about 120 degrees may be obtained. The E-Plane radiation pattern for such an HSD antenna is shown in FIG. 7. By combining three such HSD antennas together, a horizontal polarized omni-directional radiation pattern may be obtained. It is expected that an even broader E-Plane beamwidth may be achieved if the distance D4 was still further reduced. However, it should be appreciated that the distance D4 should be greater than the width W4 to prevent distortion of the E-Plane radiation pattern.

The chart below lists certain key technical specifications of the HSD antenna 40 using different distance D4 values.

| Distance D4 | E-Plane Beamwidth | Gain | F/B | Cross-Polarization |
|---|---|---|---|---|
| 70 mm | 90 Degrees | 12 dB | −22 dB | −20 dB (min) |
| 56 mm | 120 Degrees | 10.5 dB | −17 dB | −20 dB (min) |

Figure 8A:
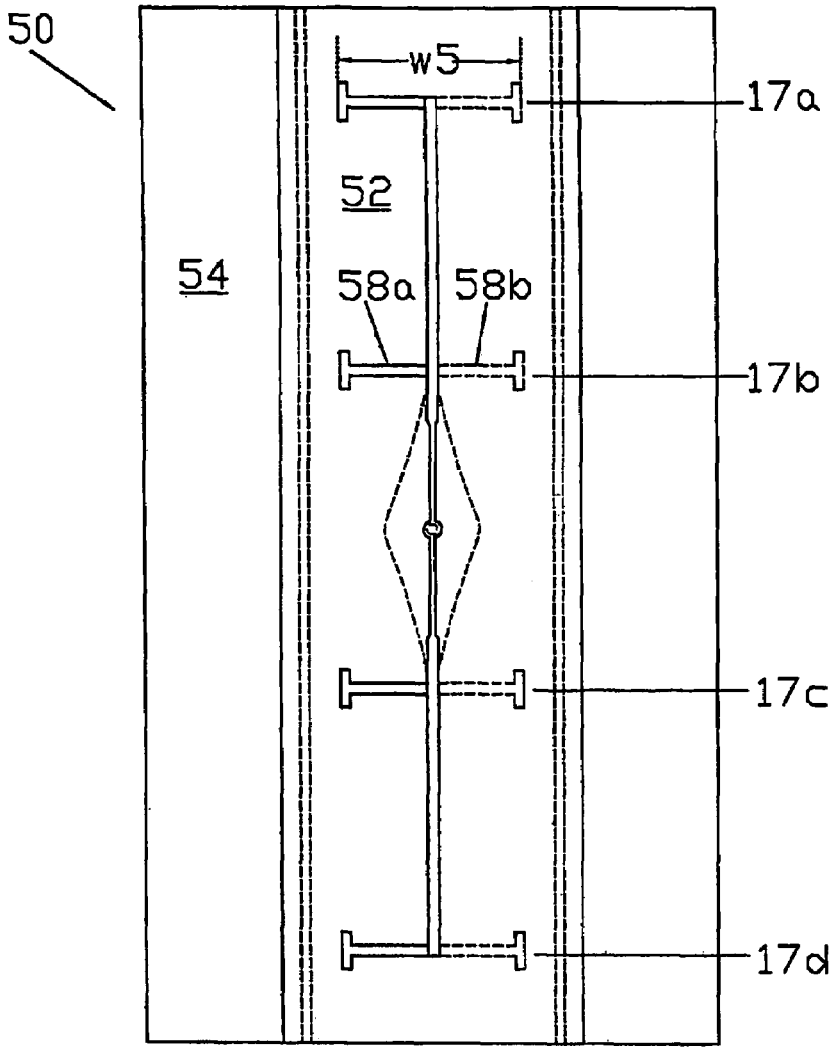
FIG. 8*a* is a top plan view of an HSD antenna similar to that shown in FIG. 5*a*, having H-shaped radiating dipoles.
Figure 8B:
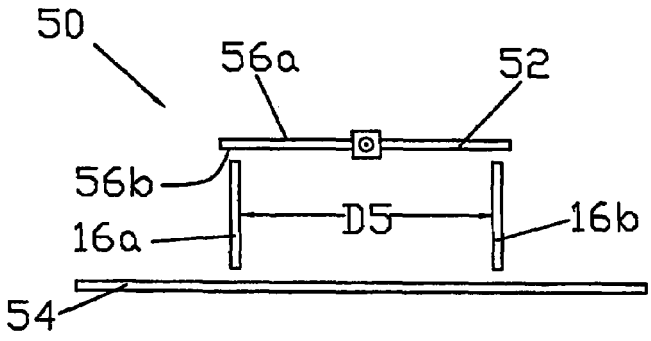
FIG. 8*b* is an exploded, end elevation view of the HSD antenna shown in FIG. 8*a*.

In the embodiment shown in FIGS. 5*a* and 5*b*, the HSD antenna 40 employed four, generally elongate, dipole elements 12*a*, 12*b*, 12*c* and 12*d*. This need not be the case in every application. In alternative embodiments, the shape of the dipole elements may be altered. Referring to FIGS. 8*a* and 8*b*, there is shown an alternate HSD antenna designated generally with reference numeral 50. The HSD antenna 50 is generally similar to HSD antenna 40 in that it has a PCB 52, a pair of conductive boards 16*a* and 16*b* and a ground plane 54. Each of these components generally resembles its counterpart component in HSD antenna 40.

More specifically, the PCB includes a generally planar, dielectric substrate 56 that has a pair of opposed faces 56*a* and 56*b* similar to faces 45*a* and 45*b* of the PCB 20. Also, in like fashion to PCB 20, the PCB 52 has four dipole elements 17*a*, 17*b*, 17*c* and 17*d*. However, the dipole elements 17*a*, 17*b*, 17*c* and 17*d* differ from their counterpart dipole elements 12*a*, 12*b*, 12*c* and 12*d* in that the former are generally H-shaped (see FIG. 8*a*). Each dipole element 17*a*, 17*b*, 17*c*, 17*d* has a pair of opposed, generally T-shaped, radiating arms 58*a* and 58*b*. The width corresponding to the span of radiating arms 58*a* and 58*b* measured end-to-end, is designated with the reference symbol W5 (see FIG. 8*a*). By providing each dipole element 17*a*, 17*b*, 17*c*, 17*d* with a pair of T-shaped radiating arms 58*a* and 58*b*, the width W5 need not be as large as width W4 in HSD antenna 40. In the result, a broad E-Plane beamwidth can be achieved without distortion, using a distance D5 that is smaller than the distance D4 which otherwise would have been required if dipole elements 12*a*, 12*b*, 12*c* and 12*d* had been employed.

Figure 9:
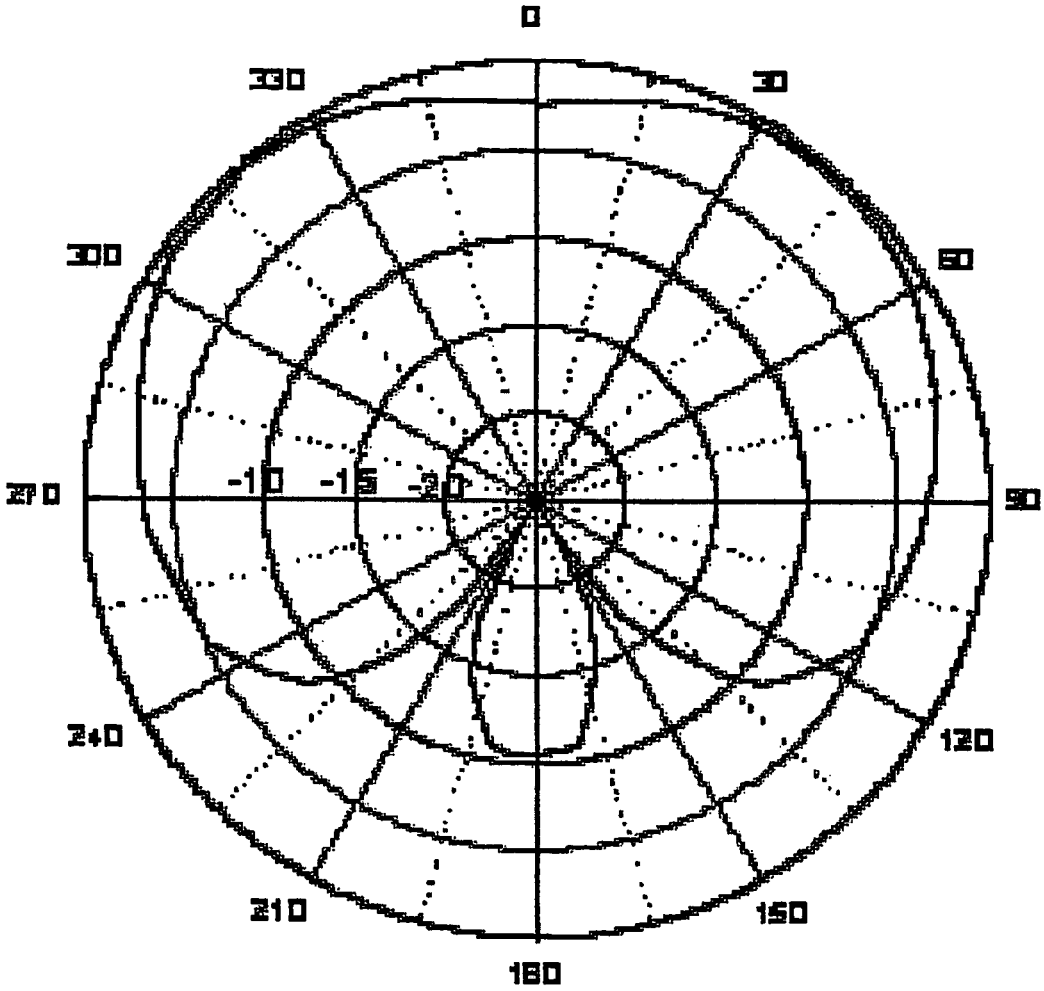
FIG. 9 is a diagram showing a plot in polar coordinates of the E-Plane radiation pattern of the HSD antenna of FIG. 8*a*, where the HSD antenna has an E-Plane beamwidth of 180 degrees.

In this embodiment, where the distance W5 measures 36 mm, it has been found that an E-Plane beamwidth of about 180 degrees may be achieved when a distance D5 of 40 mm is used. The E-Plane radiation pattern for this HSD antenna is shown in FIG. 9. The chart below lists certain key technical specifications of the HSD antenna 50 using a distance D5 value of 40 mm.

| Distance D5 | E-Plane Beamwidth | Gain | F/B | Cross-Polarization |
|---|---|---|---|---|
| 40 mm | 180 Degrees | 9 dB | −11 dB | −20 dB (min) |

It will be appreciated that a narrower E-Plane beamwidth may be achieved, by employing a greater distance D5. For instance, an E-Plane beamwidth of about 120 degrees could be achieved if a distance D5 of 72 mm were used.

Although the invention has been described with reference to certain specific embodiments, various modifications thereof will be apparent to those skilled in the art without departing from the spirit and scope of the invention as outlined in the claims appended hereto.

What is claimed is:

1. A horizontally polarized sector dipole antenna comprising:

a printed circuit board having:

a dielectric substrate provided with a pair of first and second opposed faces;

at least one dipole element formed on the dielectric substrate; the at least one dipole element having a pair of first and second, oppositely extending, dipole arms; the first dipole arm being formed on the first face of the dielectric substrate and the second dipole arm being formed on the second face thereof, the at least one dipole element having a width W corresponding to the span between the first and second dipole arms; and a feed network operatively connected to the at least one dipole element;

a pair of conductive boards mounted to the dielectric substrate to protrude from the second face thereof, the conductive boards being spaced from each other a distance D, the distance D being greater than the width W, the distance D being selected to obtain an E-Plane beamwidth for the antenna ranging from about 90 degrees to about 240 degrees; and a ground plane operatively connected to the pair of conductive boards.

2. The antenna of claim 1 wherein the E-Plane beamwidth is inversely proportional to the distance D.

3. The antenna of claim 2 wherein the antenna has a single dipole element; and the dipole arms of the single dipole element are generally straight.

4. The antenna of claim 3 wherein the E-Plane beamwidth of the antenna lies between about 120 degrees and about 240 degrees.

5. The antenna of claim 4 wherein the width W is 48 mm and the distance D lies between about 70 mm and about 60 mm.

6. The antenna of claim 5 wherein the distance D is about 70 mm and the E-Plane beamwidth of the antenna is about 120 degrees.

7. The antenna of claim 5 wherein the distance D is about 60 mm and the E-Plane beamwidth of the antenna is about 240 degrees.

8. The antenna of claim 2 wherein:

the antenna includes four dipole elements formed on the dielectric substrate;

each dipole element has a pair of first and second, oppositely extending, dipole arms, the first dipole arm being formed on the first face of the dielectric substrate and the second dipole arm being formed on the second face thereof;

each dipole element has a width W corresponding to the span between the first and second dipole arms; and the E-Plane beamwidth of the antenna ranges from about 90 degrees to about 180 degrees.

9. The antenna of claim 8 wherein the dipole arms of each dipole element are generally straight.

10. The antenna of claim 9 wherein the E-Plane beamwidth of the antenna lies between about 90 degrees and about 120 degrees.

11. The antenna of claim 10 wherein the width W is about 48 mm and the distance D lies between about 70 mm and about 56 mm.

12. The antenna of claim 11 wherein the distance D is about 70 mm and the E-Plane beamwidth of the antenna is about 90 degrees.

13. The antenna of claim 11 wherein the distance D is about 56 mm and the E-Plane beamwidth of the antenna is about 120 degrees.

14. The antenna of claim 8 wherein the dipole arms of each dipole element are generally T-shaped.

15. The antenna of claim 14 wherein the E-Plane beamwidth of the antenna lies between about 120 degrees and about 180 degrees.

16. The antenna of claim 15 wherein the width W is about 36 mm; the distance D is about 40 mm; and the E-Plane beamwidth is about 180 degrees.

* * * * *